United States Patent [19]

Akers et al.

[11] Patent Number: 4,910,367

[45] Date of Patent: Mar. 20, 1990

[54] VISIBLE BREAK SWITCH

[75] Inventors: Donald J. Akers, Chicago; Douglas J. Walker, Orland Park, both of Ill.

[73] Assignee: Joslyn Corporation, Chicago, Ill.

[21] Appl. No.: 164,527

[22] Filed: Mar. 7, 1988

[51] Int. Cl.[4] ..... H01H 33/88

[52] U.S. Cl. ..... 200/148 A; 200/144 C; 200/148 B; 200/149 A

[58] Field of Search ..... 200/144 C, 148 A, 148 B, 200/149 A

[56] References Cited

U.S. PATENT DOCUMENTS 4,168,480 9/1979 DeLucia ..... 200/144 C

*Primary Examiner*—Robert S. Macon

*Attorney, Agent, or Firm*—Mason, Kolehmainen, Rathburn & Wyss

[57] ABSTRACT

An $SF_6$ puffer interrupter switch includes one or more viewing windows located on the housing. The viewing windows are strategically located on a sidewall of the housing to allow all of the puffer interrupter assemblies within the housing to be viewed from one viewing window. The puffer interrupter assemblies that house the interrupting contacts are provided with clear puffer tubes to allow the operator to verify the position of the interrupting contacts within the puffer tubes from the viewing window located on the housing. The $SF_6$ interrupter switch housing is pressurized. By assembling the viewing window assemblies from the inside of the housing, the positive pressure within the housing assists in sealing the viewing window assemblies to minimize the leakage of the $SF_6$ gas. Additional viewing windows may be used to allow light inside the housing.

37 Claims, 2 Drawing Sheets

VISIBLE BREAK SWITCH

BACKGROUND OF THE INVENTION

1. Field of the Invention

This invention relates to a circuit interrupting switch for use at relatively high voltages and more specifically to an $SF_6$ puffer interrupter switch that permits the operator to view the interrupting contacts from the outside of the switch housing.

2. Description of the Prior Art

Circuit interrupting switches, such as $SF_6$ puffer interrupter switches, are generally old and well-known in the art. An example of such a switch is disclosed in U.S. Pat. No. 3,947,650, assigned to the assignee of the present invention. In the interrupter switch of the '650 patent, a conductive switch housing is provided with $SF_6$ gas or another dielectric gas. At least one pair of insulated feedthrough bushings are provided that are hermetically sealed to the housing. Each bushing includes a conductive member, a portion of which projects internally in the housing and a portion which projects externally of the housing. The external portions of the conductive members of the bushings are serially electrically connected to an external electrical circuit to provide the interrupting capability. The internal portions of the conductive members are coupled to an interrupting assembly located within the housing that includes a pair of interrupting contacts housed within a puffer tube, in which a stream of gas, such as $SF_6$ gas, is directed at the interrupting contacts as they begin to separate to extinguish the resulting arc.

The pressure of the $SF_6$ gas within the housing is generally greater than atmospheric pressure. In some known $SF_6$ puffer interrupters, the pressure of the $SF_6$ gas within the puffer tube is maintained at an even greater pressure than the pressure of the $SF_6$ gas within the housing to prevent liquification of the $SF_6$ gas at relatively low temperatures. Since the interrupter switch housing is pressurized, it is imperative that the housing be hermetically sealed to prevent the $SF_6$ from leaking, which could result in severe damage due to a resulting flashover within the interrupter switch assembly.

Puffer interrupter switches have been used, for example, to provide bus isolation for a unit substation bus from an incoming line feed during bus maintenance. However, prior to performing maintenance on the bus, it is necessary for the operator to verify that the interrupting contacts within the puffer tube are indeed open. In prior art air interrupter switches, visible break switch windows are provided on the housing to enable the operator to view the position of the interrupting contacts. However, leakage of an air interrupter switch will not result in damage to the switch since the air itself is the dielectric. Heretofore, such viewing windows have generally not been used on $SF_6$ interrupting switches because of the possibility of leakage of the $SF_6$ gas which may result in equipment damage.

Indirect methods thus have been utilized to determine the position of the interrupting contacts in an $SF_6$ puffer interrupter switch. One such indirect method is to examine the incoming line and bus instrumentation, such as bus voltmeters and bus ammeters, external to the interrupter. For example, if an incoming line voltmeter indicated 38 kv and the bus voltmeter indicated zero volts. This would be an indirect indication that the interrupter switch was open. An operator may also examine a bus ammeter. However, such a method of determining the position of the interrupter switch contacts is only an indirect method which is subject to errors resulting from, for example, an operator reading the wrong voltmeter or a faulty voltmeter. This method also requires external bus instrumentation which may not be otherwise practical.

Colored status flags have been provided on some interrupting devices, such as interrupting switches and circuit breakers, that are coupled to the main interrupting contacts. A red flag is used to indicate that the contacts are closed while a green flag is used to indicate that the contacts are open. An example of status flags provided on a high voltage fuse is disclosed in U.S. Pat. No. 4,186,365. However, status flags only provide an indirect indication and are subject to malfunction.

SUMMARY OF THE INVENTION

It is an object of the present invention to provide an $SF_6$ interrupter switch that overcomes the problems of determining the position of the interrupting contacts associated with the prior art.

It is a further object of the present invention to provide a positive means for determining the position of the interrupting contacts within an $SF_6$ interrupter switch without external instrumentation.

It is yet another object of the present invention to provide an $SF_6$ interrupter switch with a positive means to visibly determine the position of the interrupting contacts within the housing without the use of a status flag.

Briefly, the present invention relates to an $SF_6$ puffer interrupter switch having one or more viewing windows located on the housing. The viewing windows are strategically located on a sidewall of the housing to allow all of the puffer interrupter assemblies within the housing to be viewed through one viewing window. The puffer interrupter assemblies, that house the interrupting contacts, are provided with clear puffer tubes to allow the operator to verify the position of the interrupting contacts within the puffer tubes through the viewing window. The $SF_6$ interrupter switch housing is pressurized. By assembling the viewing window assemblies from the inside of the housing the positive pressure within the housing assists in sealing the window assemblies to minimize leakage of the $SF_6$ gas. Additional viewing windows may be provided to allow light inside the housing.

DESCRIPTION OF THE DRAWING

These and other objects, advantages and novel features of the present invention will become readily apparent upon consideration of the following detailed description and attached drawing wherein.

DETAILED DESCRIPTION

Figure 1:
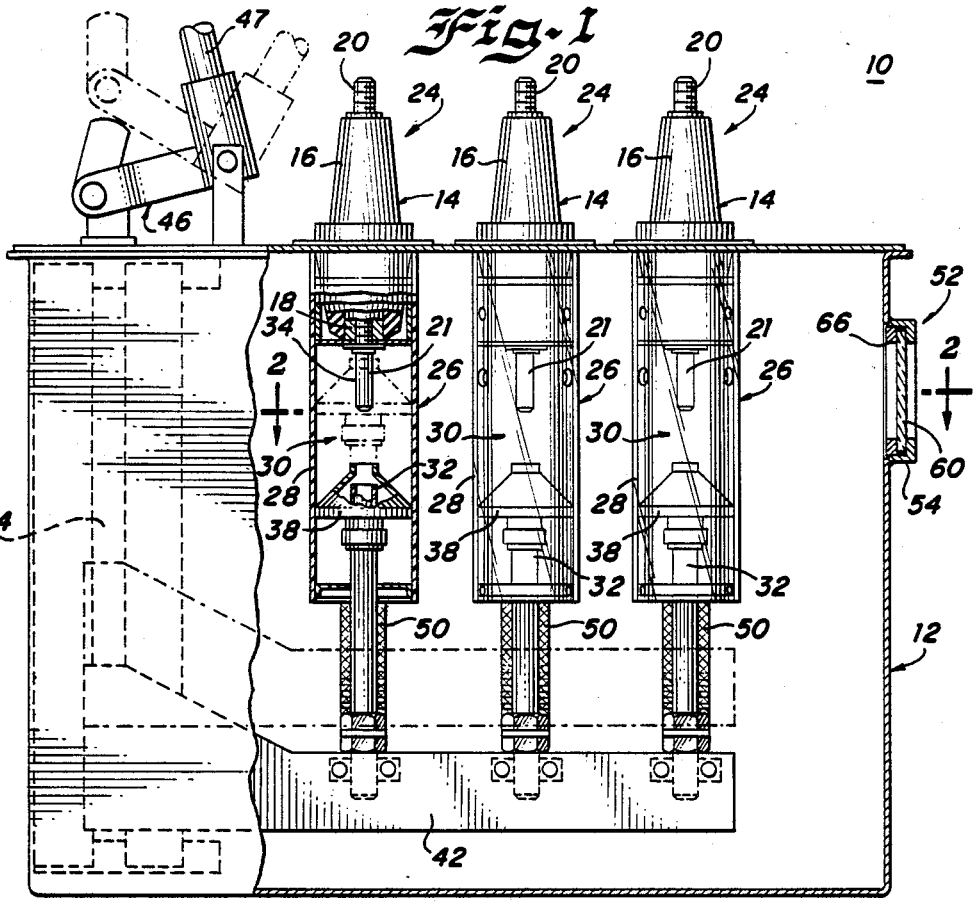
FIG. 1 is a partially broken away side elevational view of an $SF_6$ puffer interrupter switch constructed in accordance with the principles of the present invention.

Referring to the drawing and specifically to FIG. 1, an $SF_6$ puffer interrupter switch 10, constructed in accordance with the principles of the present invention, includes a generally rectangular conductive housing 12, preferably made from stainless steel, to protect the interrupter switch 10 from corrosion. The housing 12 is pressurized and hermetically sealed to prevent leakage of the $SF_6$ dielectric gas contained therewithin.

One or more pairs of feedthrough bushings 14 are located on the top of the housing 12. Each bushing 14 extends both internally and externally of the housing 12 and includes an insulated portion 16 and a conductive portion 18. The insulated portion 16 of each bushing 14 is hermetically sealed to the housing 12 to prevent leakage of the $SF_6$ gas.

The conductive portion 18 of each bushing 14 extends outwardly from the insulated portion 16, defining a conductive terminal 20 at the exterior end of the bushing 14 and a stationary conductive contact 21 at the interior end of the bushing 14 within the housing 12. The external terminals 20 are adapted to be serially connected to an external electrical circuit in which interruption capability is desired.

Figure 2:
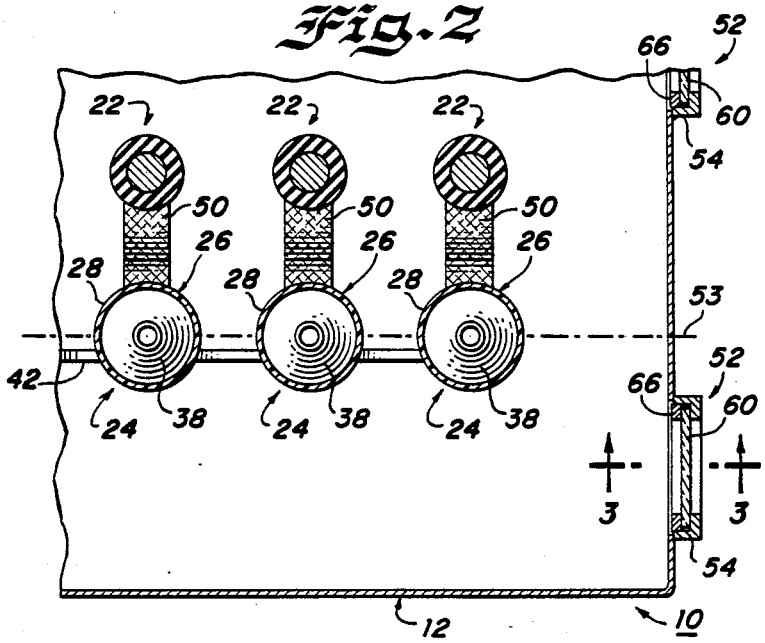
FIG. 2 is a plan sectional view of the $SF_6$ puffer interrupter switch of FIG. 1 taken along line 2—2 of FIG. 1.
Figure 4:
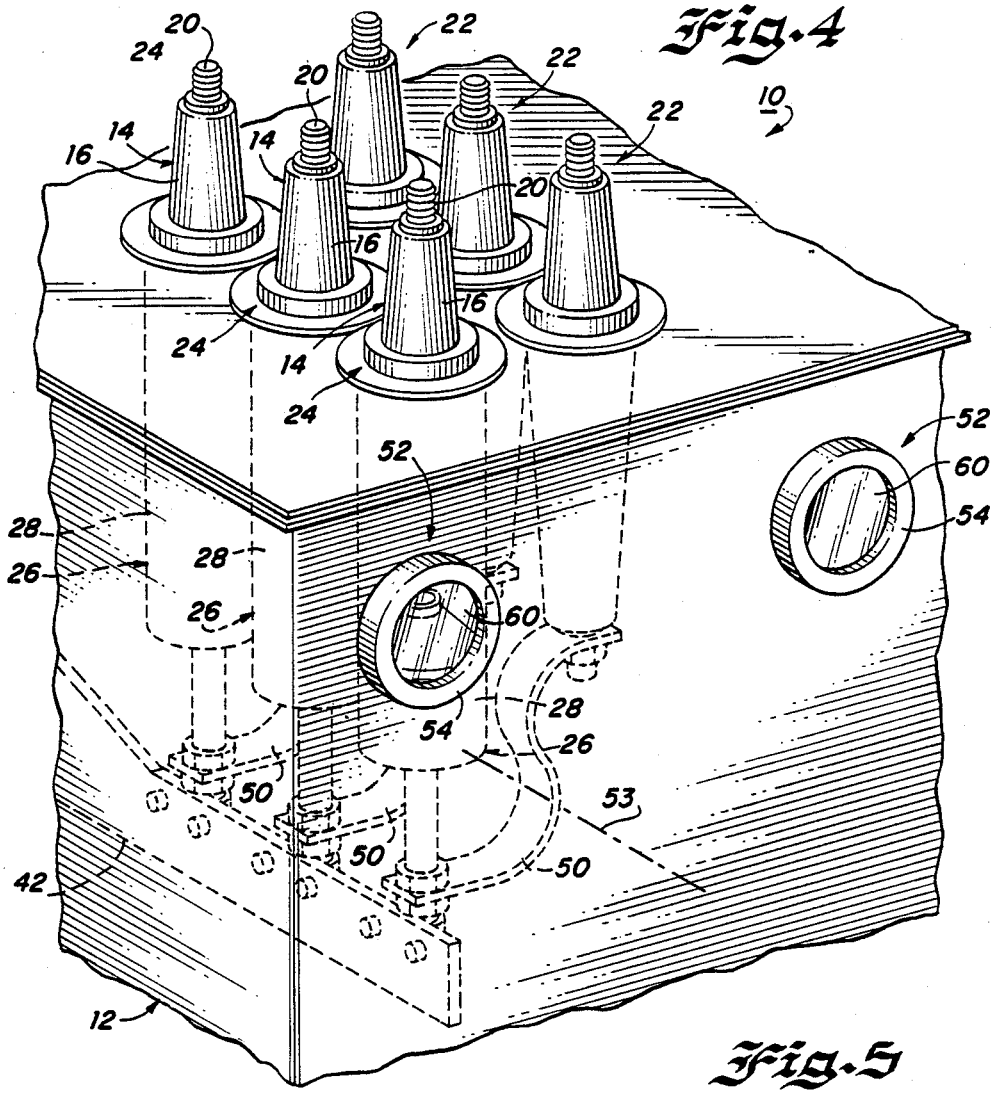
FIG. 4 is a fragmentary, perspective view of the $SF_6$ puffer interrupter of FIG. 1 showing through the viewing window the position of the interrupting contacts of one puffer interrupter assembly.

Three pairs of feedthrough bushings 14 are illustrated in FIGS. 1, 2 and 4 for use in a three phase circuit. It should be understood by those of ordinary skill in the art that the principles of the present invention are equally applicable to other configurations, including single phase, polyphase, phase-to-phase and the like.

Each pair of feedthrough bushings 14 includes a line side bushing 22 and a load side bushing 24. The line side bushing 22 is typically connected to a relatively high voltage supply, for example, a 38,000 volts or 38 kv incoming line. The load side bushing 24 is generally connected to a load such as a distribution transformer or a unit substation.

As best shown in FIGS. 1 and 4, puffer interrupter assemblies 26 are coupled between the line side bushings 22 and the load side bushings 24. As is known by those of ordinary skill in the art, puffer interrupter switches use a stream of $SF_6$ gas directed at separating electrical contacts to extinguish resultant electrical arcs. The puffer interrupter assembly 26 as well as the housing 12 contain $SF_6$ gas at a pressure between 0 and 20 psig.

Each puffer interrupter assembly 26 includes a transparent puffer tube 28 that houses the interrupting contact assemblies 30. Each contact assembly 30 includes the above-mentioned stationary contact 21 and a movable contact 32. The stationary contact 21 includes an electrode 34 that is electrically connected to the conductive portion 18 of the load side bushing 24. It should be understood, however, that the use of the electrode 34 is not critical to the practice of the invention. The movable contact 32 is formed as a female contact adapted movably to engage and disengage the electrode 34. A puffer cone 38 surrounds the female contact and forms a slidable gastight seal for directing a stream of locally highly pressurized $SF_6$ gas towards the contacts 21 and 32 as they are being separated. A detailed description of the operation of the puffer interrupter assembly is set forth in U.S. Pat. No. 3,947,650, incorporated herein by reference.

Each of the contacts 32 is rigidly fastened by suitable fastening means to a crossbar 42. The crossbar 42 is, in turn, rigidly connected to a vertical bar 44 that is secured to a rocker arm 46 pivotably connected to a top surface of the housing 12. A control rod 47 controls the rocker arm 46. Pivotal movement of the control rod 47 causes the crossbar 42 and the vertical bar 44 to move upwardly and downwardly within the housing 12 to cause the interrupting contacts 30 within the puffer tube 28 to either open or close, respectively. As shown in FIG. 1 in solid line, the interrupting contacts 30 are in the open position. The closed position of the interrupting contacts 30 is illustrated in phantom.

The contact 32, in addition to being connected to the crossbar 42, is also connected to a flexible strap 50. The strap 50 is connected to the conductive element 18 of the line side bushing 24, thus forming a complete circuit between the line side bushing 22 and the load side bushing 24 when the interrupting contacts 30 are closed.

An important aspect of the present invention is the capability of the position of the interrupting contacts 30 to be viewed by an operator outside the housing 12. This capability is provided in part by viewing window assemblies 52 provided on the housing 12. Also, a transparent material for the puffer tubes 28 is used such that the position of the interrupting contacts 30 within the puffer tube 28 is visible through the viewing window assemblies 52 (FIG. 1).

Figure 3:
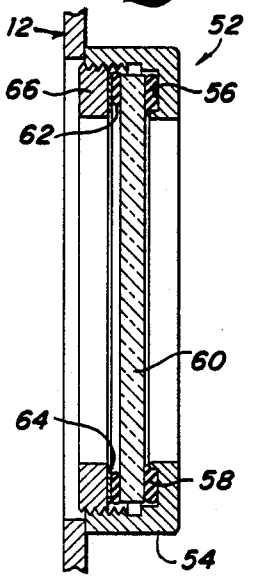
FIG. 3 is an enlarged sectional view of the viewing window of FIG. 2 taken along line 3—3 of FIG. 2.
Figure 5:
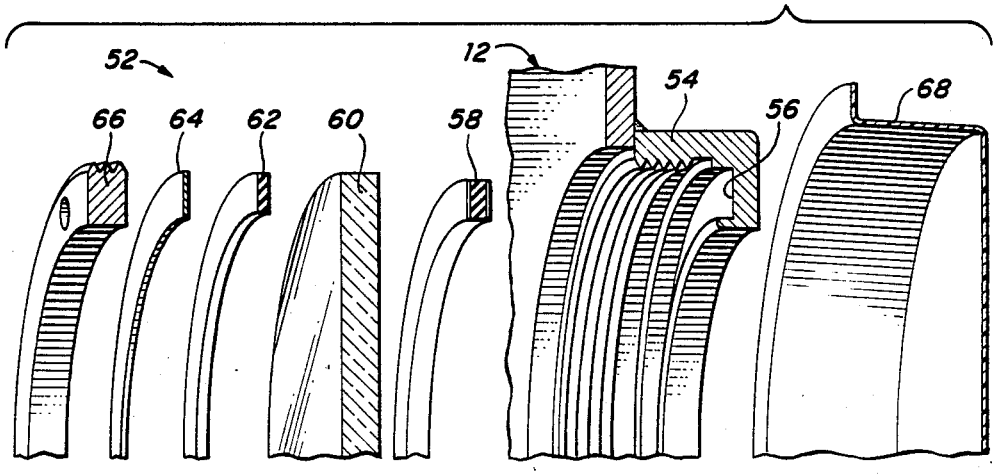
FIG. 5 is an enlarged, exploded perspective view of a viewing window of the $SF_6$ puffer interrupter switch of FIG. 1, constructed in accordance with the principles of the present invention.

The entire viewing window assembly 52 is assembled from inside the housing after a mounting ring 54 has been welded to the outside of the housing 12. Consequently, the positive pressure within the housing 12 assists in sealing the viewing window assembly 52 to prevent leakage of the $SF_6$ gas. More specifically, an aperture (not shown) is provided on a sidewall of the housing 12 for each viewing window assembly 52. A mounting ring 54, which may be made from stainless steel, is aligned with the aperture and welded to the outside of the housing 12. An annular groove 56 (FIGS. 3 and 5) is provided in the interior portion of the mounting ring 54 for receiving an interior window sealing gasket 58. A transparent viewing window 60 is then seated against the interior window gasket 58. An adhesive, such as epoxy, may be used to secure the interior window gasket 58 to the mounting ring 54. Another window sealing gasket 62 is provided between the mounting ring 54 and a slip ring 64. The slip ring 64 is used to prevent the assembly from turning and breaking the viewing window seals while a window ring clamp 66 is being tightened.

The mounting ring 54 is internally threaded. The window ring clamp 66 is correspondingly externally threaded and is screwed into the corresponding threads on the mounting ring 54 to fasten the entire assembly together. A removable protective cover 68 fits over the outside of the entire assembly to protect the viewing windows 52 during shipping.

The viewing window 60 may be made from a transparent plastic, such as from a ¼" sheet of General Electric Lexan MR5 material, which is a polycarbonate resin material. The window gaskets 58 and 62 are formed from neoprene. Various materials may be suitable for the puffer tube 28 including waterclear polysulfone, which has a dielectric constant in the range of from approximately 3 to approximately 4, and, more specifically in the range of from approximately 3.03 to approximately 3.07. Polysulphone suitable for use as the puffer tube 28 is available from Thermolux Company under the trade name UDELL POLYSULFONE.

In configurations where more than one pair of puffer interrupter assemblies 26 are provided, the puffer assemblies 26 are aligned along an axis 53 generally perpendicular to the sidewall in which the viewing window assemblies 52 are to be located. In such configurations, it is preferred that the centerline of the viewing window assemblies 52 be offset from the axis 53. This will allow all of the puffer interrupter assemblies 26 to be viewed from a single viewing window assembly 52. Otherwise, if the viewing window were to be aligned with the axis 53, the positions of the interrupting contacts 30 of some of the puffer interrupter assemblies 26 may be obscured. Also an additional viewing window 52, shown adjacent the line side feedthrough bushings in FIG. 4, may be provided to allow light into the housing 12 to allow the operator to view the position of the contacts within the puffer interrupter assemblies 26.

In operation, in order to determine the position of the interrupting contacts 30, an operator need only look through a viewing window assembly 52 to positively determine the position of the interrupting contacts 30 within the puffer interrupter assembly 24. To a limited extent, the operator will also be able to determine the condition of the interrupting contacts 30. It is also contemplated that internal pressure gauges and/or temperature gauges may be provided within the housing 12 to allow the operator to determine the relative pressure and temperature of the $SF_6$ gas within the housing through the viewing window assembly 52.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. A circuit interrupting device comprising:

a pressurized hermetically sealed housing, pressurized with a dielectric;

at least one pair of interrupting contacts disposed within said housing electrically coupled to terminals mounted on the exterior of said housing for connection to an electric circuit; and means for viewing the interrupting contacts from outside the housing;

wherein said pair of interrupting contacts comprise portions of a puffer interrupter assembly having a transparent puffer tube, within which said pair of interrupting contacts are disposed.

2. A circuit interrupting device as recited in claim 1 wherein said transparent material has a dielectric constant in the range of from approximately 3.0 to approximately 4.0.

3. A circuit interrupting device as recited in claim 2 wherein said dielectric constant is in the range of from approximately 3.03 to approximately 3.07.

4. A circuit interrupting device as recited in claim 3 wherein said transparent material is polysulfone.

5. A circuit interrupting device as recited in claim 1 wherein said viewing means includes a transparent viewing window located on a sidewall of the housing.

6. A circuit interrupting device as recited in claim 5 wherein said viewing window is formed from a polycarbonate resin.

7. A polyphase puffer interrupter switch comprising:

a hermetically sealed housing including a plurality of sidewalls, said housing being pressurized with a dielectric; and a plurality of puffer interrupter assemblies, each including a pair of interrupting contacts disposed within a transparent puffer tube.

8. A polyphase puffer interrupter switch as recited in claim 7 further comprising first viewing window means disposed on said housing for enabling an operator to verify the position of at least one pair of said interrupting contacts from outside the housing.

9. A polyphase puffer interrupter switch as recited in claim 7 wherein said plurality of puffer interrupter assemblies are aligned along an axis and said first viewing window means is located on said housing offset from said axis.

10. A polyphase puffer interrupter switch as recited in claim 9 further including second viewing window means located on said housing for permitting light to enter the housing.

11. A polyphase puffer interrupter switch as recited in claim 10 wherein said second viewing window means is spaced apart from said first viewing window.

12. A polyphase puffer interrupter switch as recited in claim 11 wherein said second window means is offset from said axis.

13. A polyphase puffer interrupter switch as recited in claim 10 wherein said second viewing window is made from a polycarbonate resin.

14. A polyphase puffer interrupter switch as recited in claim 8 said dielectric is $SF_6$ gas.

15. A polyphase puffer interrupter switch as recited in claim 8 wherein said housing is pressurized from between 0 and 20 psig.

16. A polyphase puffer interrupter switch as recited in claim 8 wherein said transparent puffer tube is made from polysulfone.

17. A polyphase puffer interrupter switch as recited in claim 8 wherein said first viewing window means is made from a polycarbonate resin.

18. A viewing assembly for use with a gas filled, pressurized and hermetically sealed switch housing comprising:

a mounting ring adapted to be welded around an aperture provided on the housing, wherein said mounting ring is formed with an inwardly facing annular groove;

a first gasket which is received in said annular groove;

a viewing window having one side sealed against said first gasket;

a second gasket that seats against the other side of said viewing window;

a slip ring that seats against said second gasket; and a window ring clamp that seats against the slip ring and fastens the entire assembly together.

19. A viewing assembly as recited in claim 18 further including a protective cover adapted to be placed over the outside of the viewing assembly for protection during shipping of said switch.

20. A viewing assembly as recited in claim 18 wherein said first gasket is formed from neoprene.

21. A viewing assembly as recited in claim 18 wherein said second gasket is formed from neoprene.

22. A viewing assembly as recited in claim 18 wherein said viewing window is formed from a polycarbonate resin.

23. A viewing assembly as recited in claim 18 wherein said pressurized housing is adapted to be pressurized from between 0 and 20 psig.

24. A puffer interrupter switch comprising:

a hermetically sealed housing filled with dielectric gas under pressure;

a plurality of pairs of feedthrough bushings hermetically sealed to said housing, each of said bushings having an electrical terminal extending externally of said housing for connection to an external electric circuit and an electrical terminal disposed within said housing;

a plurality of puffer interrupter assemblies disposed within said housing and aligned along a linear axis, each of said assemblies having a pair of interrupting contacts disposed within a transparent tube, said interrupting contacts being electrically coupled to said electrical terminals disposed within said housing;

means for moving said interrupting contacts into and out of contact; and means for viewing at least one of said interrupting contacts from outside said housing.

25. A puffer interrupter switch as recited in claim 24 wherein said dielectric gas is $SF_6$.

26. A puffer interrupter switch as recited in claim 24 wherein said housing is pressurized from between 0 and 20 psig.

27. A puffer interrupter switch as recited in claim 24 wherein said viewing means comprises:

a transparent viewing window sealed to said housing.

28. A puffer interrupter switch as recited in claim 24 wherein said viewing means is located in a sidewall of said housing.

29. A puffer interrupter switch as recited in claim 24 wherein said viewing means is offset from said axis.

30. A puffer interrupter switch as recited in claim 24 further including means releasably secured to said viewing means for protecting said viewing means during shipping of said switch.

31. A puffer interrupter switch as recited in claim 24 further including means separate from said viewing means for allowing outside light into said housing.

32. A puffer interrupter switch as recited in claim 31 wherein said light allowing means is located along the same side of said housing as said viewing means.

33. A puffer interrupter switch as recited in claim 31 wherein said light allowing means is offset from said axis.

34. A puffer interrupter switch comprising:

a hermetically sealed rigid, metal housing, said housing being pressurized with a dielectric; and a puffer interrupter assembly within said housing, said assembly including a pair of interrupting contacts disposed within a transparent puffer tube.

35. A puffer interrupter switch as recited in claim 34 further comprising viewing window means disposed on said housing for enabling an operator to verify the position of said interrupting contacts from outside of said housing.

36. A method of determining the position of a pair of interrupting contacts disposed within a pressurized metal housing of a switch from outside of said housing comprising the steps of:

hermetically sealing said housing;

pressurizing said housing with a dielectric gas; and providing at least one puffer interrupting assembly within the housing including a pair of interrupting contacts disposed within a transparent tube.

37. A method of determining the position of a pair of interrupting contacts disposed within a pressurized metal housing of a switch from outside of said housing, as recited in claim 36, further comprising the step of providing a viewing means on said housing, for enabling an operator to verify the position of said interrupting contacts from outside of said housing.

* * * * *

Disclaimer and Dedication 4,910,367.—*Donald J. Akers*, Chicago; *Douglas J. Walker*, Orland Park, both of Ill. VISIBLE BREAK SWITCH. Patent dated Mar. 20, 1990. Disclaimer and Dedication filed July 30, 1990, by the assignee, Joslyn Corp.

Hereby disclaims and dedicates to the Public the remaining term of said patent.

[*Official Gazette September 25, 1990* ]